United States Patent [19]

Mayer

[11] Patent Number: 5,052,275

[45] Date of Patent: Oct. 1, 1991

[54] HORIZONTAL RECIPROCATING COMPRESSOR WITH AN ECCENTRICALLY ADJUSTABLE PISTON THEREIN

[75] Inventor: Roland Mayer, Oberwil, Switzerland

[73] Assignee: Sulzer Brothers Limited, Winterthur, Switzerland

[21] Appl. No.: 626,277

[22] Filed: Dec. 12, 1990

[51] Int. Cl.[5] ..... F01B 29/04

[52] U.S. Cl. ..... 92/59; 92/165 R; 92/201; 92/257; 92/258; 74/471 M

[58] Field of Search ..... 92/59, 139, 165 R, 201, 92/202, 203, 204, 205, 206, 207, 255, 257, 258; 74/471 M

[56] References Cited

U.S. PATENT DOCUMENTS 463,538 11/1891 McCully ..... 74/571 M
924,307 6/1909 Bauroth ..... 74/571 M
1,054,588 2/1913 Meng ..... 74/571 M
1,835,662 12/1931 McAllister .
2,843,433 7/1958 Burnand ..... 92/201
3,036,873 5/1962 Norwood ..... 309/17

FOREIGN PATENT DOCUMENTS 2061063 6/1971 Fed. Rep. of Germany .
0709490 8/1931 France .

*Primary Examiner*—John T. Kwon
*Assistant Examiner*—Thomas Denion
*Attorney, Agent, or Firm*—Kenyon & Kenyon

[57] ABSTRACT

The horizontal reciprocating compressor is provided with a cylinder, piston and piston rod connected to the piston. An eccentric ring is mounted eccentrically within the piston and rotatably receives the piston rod. Rotation of the eccentric ring from time to time serves to move the axis of the piston rod vertically relative to the axis of the piston so as to eliminate runout.

10 Claims, 2 Drawing Sheets

HORIZONTAL RECIPROCATING COMPRESSOR WITH AN ECCENTRICALLY ADJUSTABLE PISTON THEREIN

This invention relates to a horizontal reciprocating compressor.

As is known, horizontal reciprocating compressors have usually been constructed of a horizontally disposed cylinder and a piston which is guided in the cylinder and driven by a crankshaft via a piston rod and crosshead. Usually, the piston is releaseably connected to the end of piston rod. In addition, the piston rod usually passes through a sealing gland within the cylinder while ring seals are provided on the gland to form a seal with the piston rod.

A problem with compressors of this kind is that the piston-carrying end of the piston rod secured to the crosshead bends out downwardly and so its axis departs from ideal horizontality. This departure increases during the working life of the compressor because of piston wear or wear of the piston guide rings if the piston is provided therewith. This departure is known technically as "runout" and the construction guidelines of the United States petroleum industry lay down specific tolerances for the amount of runout. To compensate for excessive runout, it is known to adjust the axis of the crosshead and, therefore, of the piston rod securement. A disadvantage of this step is that the crosshead and the piston rod must be misaligned relative to the cylinder and to the gland in which the piston rod extends through the cylinder end wall The result is one-sided play between the piston rod and the gland, with the result that the ring seals thereof bear eccentrically with a possible reduction in working life.

Accordingly, it is an object of the invention to obviate the need to adjust a crosshead axis within a horizontal reciprocating compressor while minimizing piston rod runout.

It is another object to the invention to provide a relatively simple construction to compensate for runout in a horizontal reciprocating compressor.

It is another object to the invention to simplify the adjustments necessary to correct for runout in a horizontal reciprocating compressor.

Briefly, the invention provides a reciprocating compressor which comprises a horizontally disposed cylinder, a piston reciprocally mounted in the cylinder along a longitudinal axis thereof, a piston rod releaseably connected to the piston and extending along a longitudinal axis and an eccentric ring which is rotatably mounted in the piston and which rotatably receives the piston rod therein. The eccentric ring is such that the outer peripheral surface is eccentric to an inner peripheral surface thereof such that upon rotation of the ring, the axis of the piston rod is moved relative to the axis of the piston.

A suitable drive means is also provided for driving the piston rod. For example, the drive means may include a crosshead connected to the piston rod at one end and a crankshaft which is drivingly connected to the crosshead for reciprocating the crosshead, piston rod and piston.

The piston is constructed with a bore which extends completely therethrough with the piston rod extending in the bore. In addition, near the piston end face near the crosshead, the bore widens into a widened bore part disposed eccentrically of the piston outer diameter (periphery) and the eccentric ring is disposed between the widened bore part and the piston rod extending thereinto. The inner bore diameter of the eccentric ring is equal to the diameter of the piston rod while the outer diameter of the eccentric ring, such diameter being eccentric of the inner bore, is equal to the diameter of the widened bore part. The eccentricity of the widened part of the piston bore and the provision of the eccentric ring enable the piston axis to be so adjusted relative to the piston rod axis that the latter axis meaning remains in alignment with the crosshead axis and the cylinder axis. This adjustment can be carried out both at the initial assembly of the compressor and also periodically in operation—i.e., when the piston has worn in operation or because the piston guide rings may have worn and the permissible runout tolerance has been exceeded. Another advantage of the arrangement is that it is constructionally simpler to provide an eccentric ring than for the crosshead axis to be adjustable. Also, manipulation of the eccentric ring to adjust the piston is simpler than adjustment of the crosshead axis.

These and other objects and advantages of the invention will become more apparent from the following detailed description taken in conjunction with the accompanying drawing wherein:

FIG. 1 diagrammatically illustrates a reciprocating compressor constructed in accordance with the invention;

Figure 2:
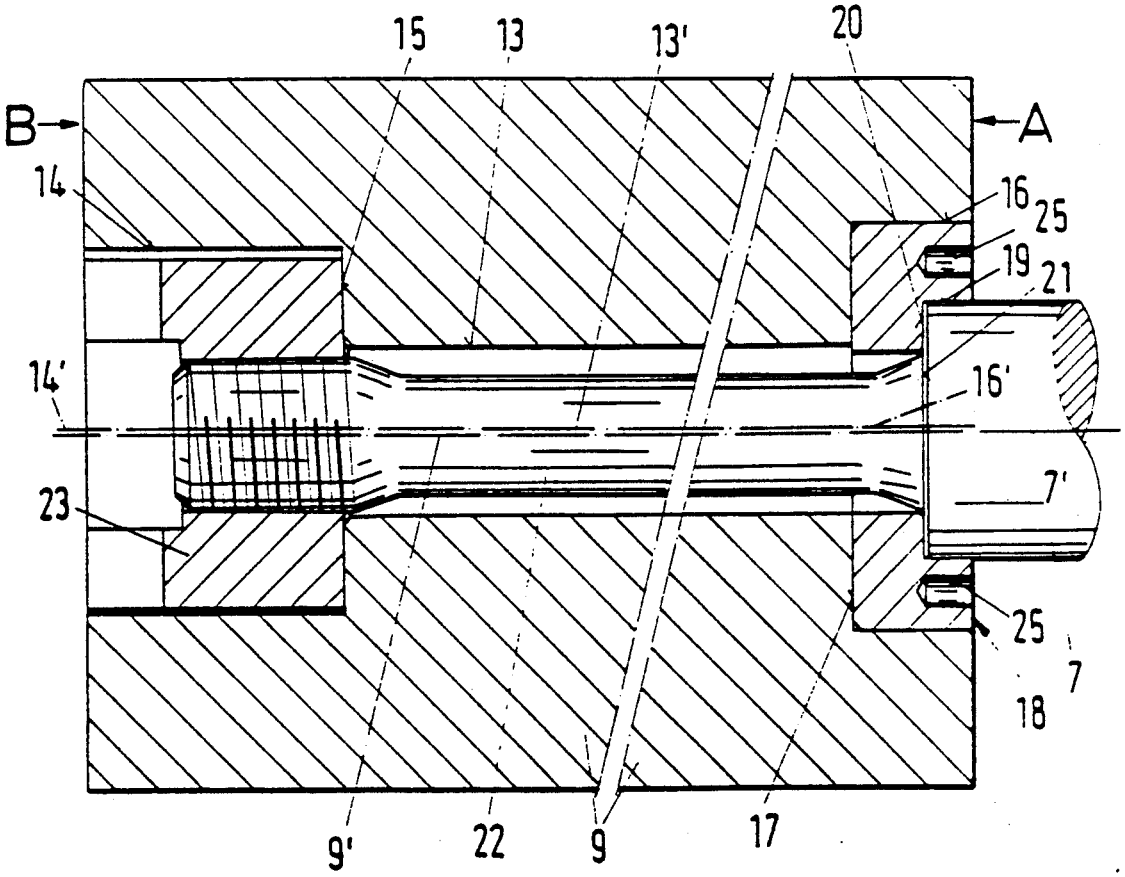
FIG. 2 illustrates an enlarged view of the mounting of the piston of the compressor on a piston rod in accordance with the invention.
Figure 3:
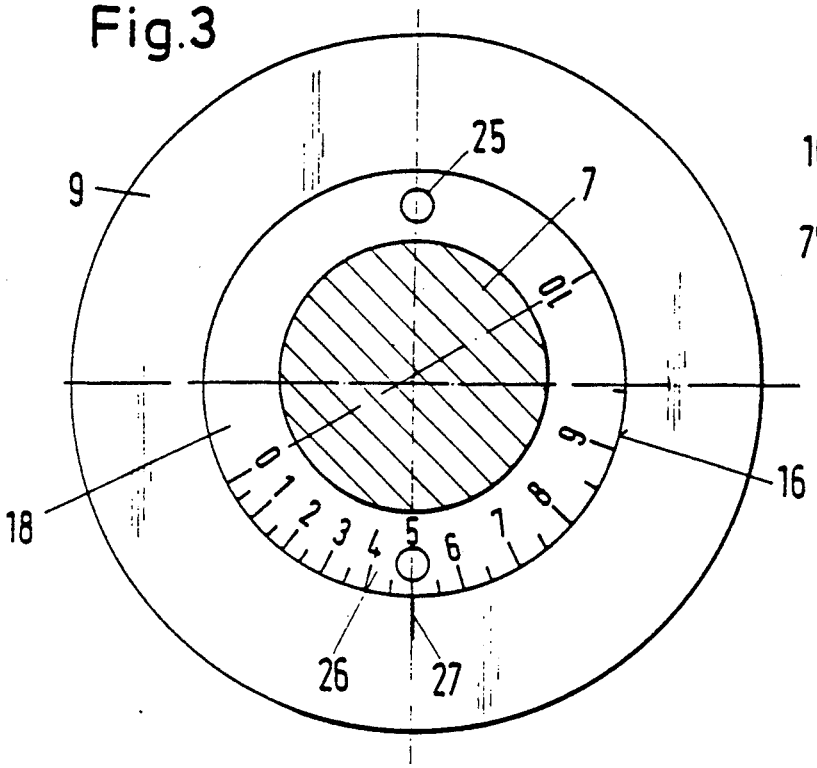
FIG. 3 illustrates an end view taken in the direction of arrow A in FIG. 2, illustrating the eccentric ring in accordance with the invention.
Figure 3A:
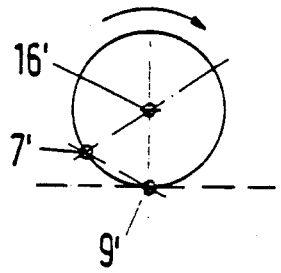
Figure 4A:
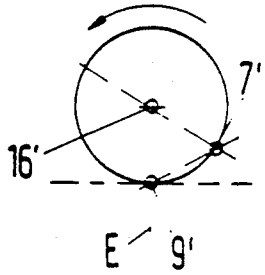
Figure 4:
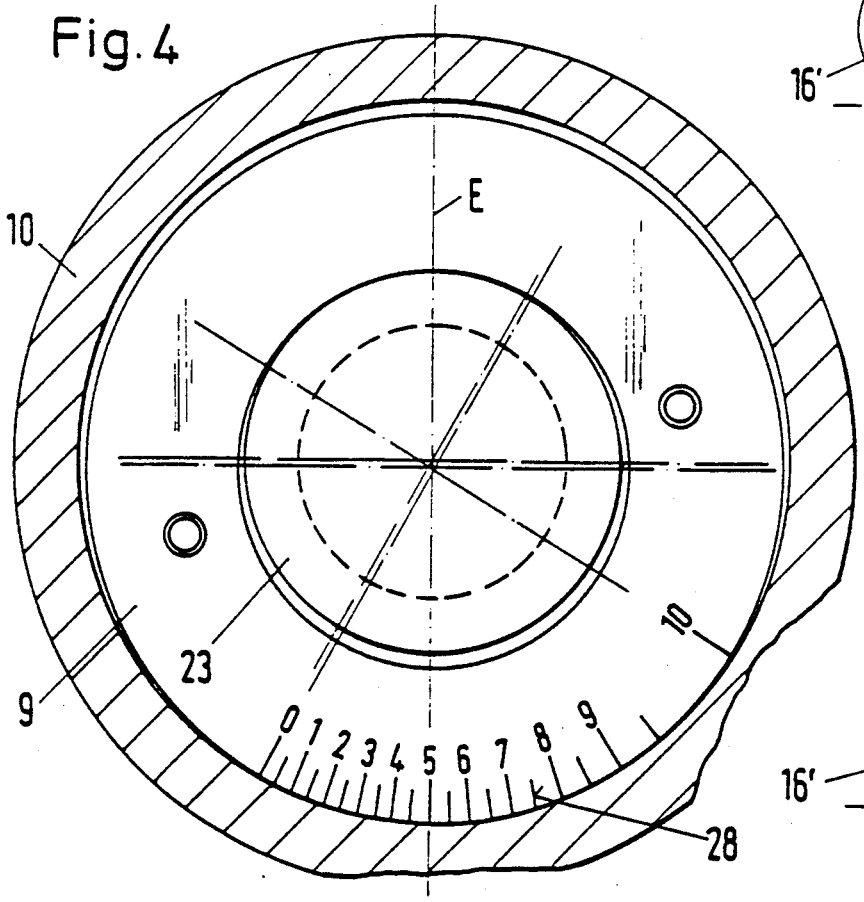
Figure 4B:
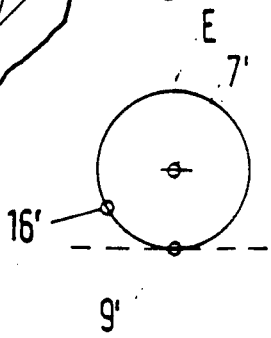

FIG. 3*a* schematically illustrates a geometric relationship between the axes of the piston rod, piston, and axis of the widened bore part which receives the eccentric ring;

FIG. 4 illustrates an end view taken in the direction of arrow B in FIG. 2;

FIG. 4*a* illustrates a view similar to FIG. 3*a* from an opposite end of the piston; and FIG. 4*b* illustrates a vertical alignment of the axis of the piston rod with the axis of the piston in accordance with the invention.

Figure 1:
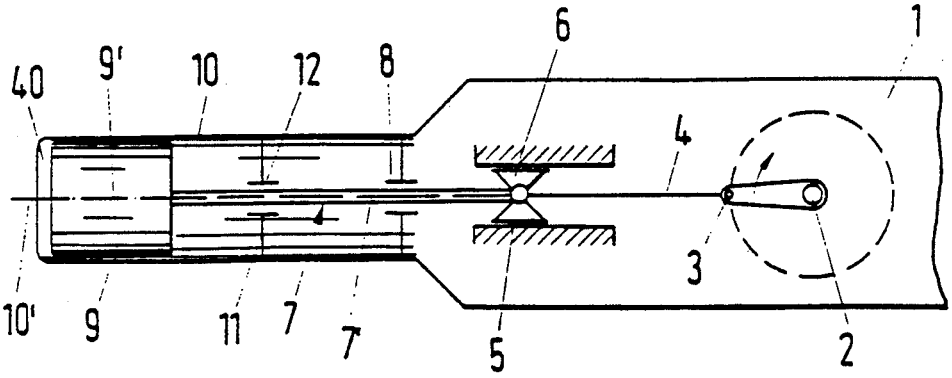

Referring to FIG. 1, a reciprocating compressor has a crankcase 1 in which a crankshaft 2 is mounted. A connection rod 4 is connected to a crankpin 3 of the crankshaft 2 and at the left-hand end, as viewed, is pivotally connected to a pin 5 which is part of a horizontally and rectilinearly reciprocating crosshead 6. A piston rod 7 is secured to the crosshead 6, extends through the crankcase 1 near an oil scraper 8 and is releasably connected at the left-hand end, as viewed to a piston 9. The piston 9 has, in known manner, piston and guide rings (not shown) which are made, for example, of plastics.

The piston 9 is guided in a cylinder 10 connected to the crankcase 1 and is reciprocated horizontally by the piston rod 7. When the piston 9 moves towards the crankcase 1, gas for compression is sucked into a cylinder chamber 40 formed by the piston 9 and cylinder 10 via suitable means, as is known, and then compressed when the piston 9 moves in the opposite direction. Near the place where the piston 9 reverses from its suction or intake stroke to its compression stroke, an end wall 11 is provided between the piston 9 and the oil scraper 8 in the cylinder 10 and has a sealing gland 12 near the leadthrough of the piston rod 7, which gland extends around the piston rod 7.

In FIG. 1, the reference 7′ denotes the axis of the piston rod 7, the reference 9′ denotes the axis of the piston 9 and the reference 10′ denotes the axis of the cylinder 10. In contrast to normal practice, the latter three axes are in this case shown in alignment with one another.

Referring to FIG. 2, the piston 9 is formed with a continuous bore 13 whose axis 13′ is eccentric of the piston axis 9′—i.e., of the axis of rotation of the peripheral or outside surface of the piston 9. At the left-hand end, as viewed, the bore 13 widens into a widened bore part 14 whose axis 14′ is in alignment with the axis 13′. There is a shoulder 15 between the bores 13 and 14. The right-hand end of the bore 13, as viewed, also widens into a widened bore part 16 whose axis 16′ is in alignment with the axis 13′ and which merges by way of a shoulder 17 into the bore 13.

Disposed in the widened bore part 16, which is also eccentric of the piston outer periphery, is an eccentric ring 18 whose outer diameter, neglecting the necessary tolerances, is equal to the diameter of the widened bore part 16. With the ring 18 in the position shown, the axis of its outer periphery is in alignment with the bore part axis 16′. The inner bore 19 of the ring 18 is eccentric of the outer periphery thereof and, neglecting the necessary tolerances, is equal to the diameter of the piston rod 7, the inner bore 19 extending around an end part of the piston rod 7. The axis of the inner bore 19 is in alignment with the piston rod axis 7′. At the left-hand end, as viewed, the inner bore 19 merges into a shoulder 20 on which, after assembly, the piston rod 7 bears by way of an end face 21.

Referring to FIG. 2, a prolongation 22 extends to the left from the piston rod end face 21, passes through the bore 13 in the piston 9 and has a screwthread at one end which extends into the widened bore part 14. A nut 23 is screwed onto the screwthread, engages the shoulder 15 and secures the connection of the piston rod 7 to the piston 9. The ring 18 is formed on its outer end face with two diametrically opposite blind bores 25 adapted to receive an appropriate tool for adjusting the ring 18.

Referring to FIG. 3, the ring 18 has a scale 26 on an outside end face which reads from zero to 10 and which extends over half the periphery of the ring 18. At the lowest place of the widened bore part 16 of the piston 9, the end face thereof is marked with a mark 27. This scale 26 is indicative of the eccentricity of the ring 18 relative to the piston 9.

As can be gathered from FIG. 3*a*, in the assembly shown by way of example in FIG. 3, the piston rod axis 7′ is disposed to the left above the piston axis 9′ whereas the axis 16′, which is identical with the position of the axis of the outer periphery of the ring 18, is disposed to the right of the axis 7′ and above the axis 9′. This exemplified state may occur on assembly or at some time after operation of the compressor.

Referring to FIG. 4, a scale 28 is also provided on the piston end face remote from the crosshead. This scale 28 extends over 25% of the piston periphery and like the scale 26 has markings from zero to 10. The scale 28 is indicative of the position of the piston 9 within the cylinder 10.

The piston 9 is adjusted relative to the piston rod 7 as follows: When the scale mark 0 of eccentric ring 18 is opposite the mark 27, the piston rod 7 is dead center of the piston 9—i.e., the axes 7′ and 9′ coincide. Since in practice the piston rod axis 7′ departs from ideal horizontality, the two axes are so adjusted relative to one another that the piston rod axis 7′ at least approximates to the ideal position of the horizontal axis 9′. Measurements can be made on the piston rod 7 to determine the magnitude of the departure of the piston rod axis 7′ from the horizontal axis 9′ and, from the result, the magnitude of the scale value for rotating the eccentric ring 18 can be determined. In the example shown in FIGS. 3 and 4, (FIG. 4 being a view from the opposite end from FIG. 3) this scale value is 5. Consequently, before the nut 23 is tightened, the ring 18 is rotated clockwise in FIG. 3 (counter-clockwise in FIG. 4) until the 5 scale mark registers with the mark 27. Consequently, the piston rod axis 7′ is raised vertically relative to the piston axis 9′, as can be seen in FIGS. 3*a* and 4*a*. The nut 23 is now tightened so that no further alteration occurs in the relative positions of the piston 9 and piston rod 7. Next, the piston 9 together with the piston rod 7 secured therein is rotated anticlockwise, as viewed in FIG. 4 relative to the cylinder 10 from the position shown in FIG. 4*a* into the position shown in FIG. 4*b* to ensure that the piston rod axis 7′ and the piston axis 9′ are disposed in a common vertical plane E with the cylinder axis 10′. This is effected by means of the scale 28 by its value 5 being adjusted to register with the vertical plane E in which the cylinder axis 10′ is disposed, as illustrated in FIGS. 4 and 4*b*. The piston rod 7 and crosshead 6 are then secured definitively to one another.

In the embodiment described, the piston bore 13, 14, 16 and the eccentric ring 18 have equal eccentricities. If required, these eccentricities can differ from one another.

Also the bores 13, 14 can be concentric of the outer periphery of the piston 9, in which event the clearance between the prolongation 22 and the bore 13 and the clearance between the nut 23 and the bore part 14 must be dimensioned correspondingly. Another possibility is for the scale 28 to be fitted to the piston end face near the crosshead. The eccentric ring 18, instead of being formed with the blind bores 25, can have differently contrived surfaces engageable by the adjusting tool.

The invention thus provides a horizontal reciprocating compressor in which runout can be readily and simply corrected from time to time. Further, the invention provides a horizontal reciprocating compressor which obviates the need to adjust a crosshead axis.

What is claimed is:

1. A reciprocating compressor comprising
   - a horizontally disposed cylinder;
   - a piston reciprocably mounted in said cylinder;
   - a piston rod releaseably connected at one end to said piston;
   - a crosshead connected to said piston rod at a second end opposite said one end;
   - a crankshaft drivingly connected to said crosshead for reciprocating said crosshead, said piston rod and said piston; and
   - an eccentric ring rotatably mounted in said piston and rotatably receiving said piston rod therein, said ring having an outer peripheral surface eccentric to an inner peripheral surface thereof.

2. A reciprocating compressor as set forth in claim 1 wherein said inner peripheral surface has a diameter equal to the diameter of said piston rod.

3. A reciprocating compressor as set forth in claim 1 wherein said piston has a bore extending therethrough with said piston rod extending in said bore, said bore having a widened bore portion at one end receiving said eccentric ring therein in rotatable relation.

4. A reciprocating compressor as set forth in claim 3 wherein said bore has a second widened bore part at an end opposite said one end to receive said piston rod therein and which further comprises a nut within said second bore part connecting said piston rod to said piston.

5. A reciprocating compressor as set forth in claim 4 wherein said second bore is eccentric to an outer periphery of said piston rod and is of the same eccentricity as said ring.

6. A reciprocating compressor as set forth in claim 1 wherein said ring has a scale thereon indicative of the eccentricity of said ring relative to said piston.

7. A reciprocating compressor as set forth in claim 6 wherein said piston has a scale thereon indicative of the position of said piston within said cylinder.

8. In a reciprocating compressor, the combination comprising a horizontally disposed cylinder;

a piston reciprocably mounted in said cylinder along a longitudinal axis thereof;

a piston rod releaseably connected to said piston and extending along a longitudinal axis; and an eccentric ring rotatably mounted in said piston and rotatably receiving said piston rod therein, said ring having an outer peripheral surface eccentric to an inner peripheral surface thereof for moving said axis of said piston rod relative to said piston in response to rotation of said ring.

9. The combination as set forth in claim 8 wherein said ring has a scale thereon indicative of the eccentricity of said ring relative to said piston.

10. The combination as set forth in claim 8 wherein said piston is rotatable in said cylinder and has a scale thereon indicative of the position of said piston within said cylinder to align said axes in a common vertical plane.

* * * * *